US007179067B2

(12) United States Patent
Bush et al.

(10) Patent No.: US 7,179,067 B2
(45) Date of Patent: Feb. 20, 2007

(54) SCROLL COMPRESSOR WITH WRAP WALLS PROVIDED WITH AN ABRADABLE COATING AND A LOAD-BEARING SURFACE AT RADIALLY OUTER LOCATIONS

(75) Inventors: James William Bush, Skaneateles, NY (US); Robert Wilson, Canton, CT (US); Bruce A. Fraser, Manlius, NY (US)

(73) Assignee: Scroll Technologies, Arkadelphia, AR (US)

( * ) Notice: Subject to any disclaimer, the term of this patent is extended or adjusted under 35 U.S.C. 154(b) by 535 days.

(21) Appl. No.: 10/756,019

(22) Filed: Jan. 13, 2004

(65) Prior Publication Data

US 2005/0152793 A1 Jul. 14, 2005

(51) Int. Cl.
*F03C 2/00* (2006.01)
*F04C 18/00* (2006.01)

(52) U.S. Cl. ..... 418/55.2; 418/55.1; 418/178

(58) Field of Classification Search ..... 418/55.1–55.6, 418/57, 178; 29/888.022
See application file for complete search history.

(56) References Cited

U.S. PATENT DOCUMENTS 6,887,052 B1 * 5/2005 Bush et al. ..... 418/55.2

FOREIGN PATENT DOCUMENTS

JP 05280478 A * 10/1993 ..... 418/55.2
JP 2000130366 A * 5/2000

* cited by examiner

*Primary Examiner*—Theresa Trieu
(74) *Attorney, Agent, or Firm*—Carlson, Gaskey, & Olds

(57) ABSTRACT

An abradable coating is formed on portions of the flank wall of the wraps of a scroll compressor. The radially outer portions of the flank wall are left uncoated, and can bear a force between the scroll wraps. In this manner, the load is not transferred through a coated portion, but rather through the uncoated portion. As the scroll wraps move relative to each other at run-in, the abradable coating wears away leaving a tight fit between the flank walls at the radially inner locations.

10 Claims, 3 Drawing Sheets

SCROLL COMPRESSOR WITH WRAP WALLS PROVIDED WITH AN ABRADABLE COATING AND A LOAD-BEARING SURFACE AT RADIALLY OUTER LOCATIONS

BACKGROUND OF THE INVENTION

A scroll compressor has at least one of its wrap walls provided with an abradable coating to eliminate wrap leakage between opposed walls of the orbiting and non-orbiting scroll. The coating is only provided at radially inner locations, with radially outer locations being left to bear the load between the orbiting and non-orbiting scrolls.

Scroll compressors are becoming widely utilized in refrigerant compression applications. In a scroll compressor, a pair of interfitting scroll members each have a base and a generally spiral wrap extending from its base. The wraps interfit to define compression chambers. One of the two scrolls is caused to orbit relative to the other. As the orbiting movement occurs, the wrap walls are brought into contact, and the wrap tips are brought into contact with the floor of the base of the opposed scroll. As the orbiting movement occurs, the compression chambers are reduced in volume, thus compressing the entrapped refrigerant.

A scroll compressor as known in the prior art is shown at 20 in FIG. 1. The orbiting scroll 22 is placed adjacent the non-orbiting scroll 24. The orbiting scroll 22 has a generally spiral wrap 26 extending from the floor 27 of its base. The non-orbiting scroll 24 has its own generally spiral wrap 28 extending from its base 29.

As shown in FIG. 2, this prior art compressor has contact between the flank walls of the scroll wraps 26 and 28 to define the compression chambers. As an example, one intended point of contact between the wraps 26 and 28 is shown at 30 and 32. These points of contact define compression chambers such as compression chambers 100 and 102. Other points of contact are shown at C. However, as shown in FIG. 3, there have sometimes been gaps such as gap 34 between the points 30 and 32. When this occurs, there is potential leakage between chambers 100 and 102 which will reduce the efficiency of the compression process. The gap 34 can be caused due to machining variations, thermal distortion, or other problems. Generally, such scroll compressors are "radially compliant," allowing one of the wraps to move into abutting contact with the other at at least one point. However, as can be appreciated from FIG. 2, it would be desirable to have contact at several points C. It has been somewhat difficult due to the tolerance issues, etc. mentioned above, to ensure that each of the contact points will meet during operation. Again, this may result in a decrease in efficiency.

While coatings have been proposed for the wraps of scroll compressors, they have generally been along the entire length of the wrap. To have the coating along the entire length would have undesirable characteristics.

SUMMARY OF THE INVENTION

In the disclosed embodiment of this invention, a coating is provided adjacent radially inner or central portions of the wrap of at least one of the two scroll members. The coating is preferably made of an abradable or conformable material and thick enough such that after run-in of the scroll compressor, the coating will remain to eliminate gaps such as the prior art gap (FIG. 3, 34) by ensuring that the coating will only be worn away as would be necessary to adjust to the particular tolerances, etc. for the particular scroll elements.

Preferably, the coating is formed at a location spaced radially inward somewhat from the beginning of the wrap. The radially outer portions of the wrap will bear the radial load between the two wrap members. It would be undesirable to have this load carried by the coating entirely, since the coating may then wear away.

These and other features of the present invention can be best understood from the following specification and drawings, the following of which is a brief description.

DETAILED DESCRIPTION OF THE PREFERRED EMBODIMENT

Figure 1:
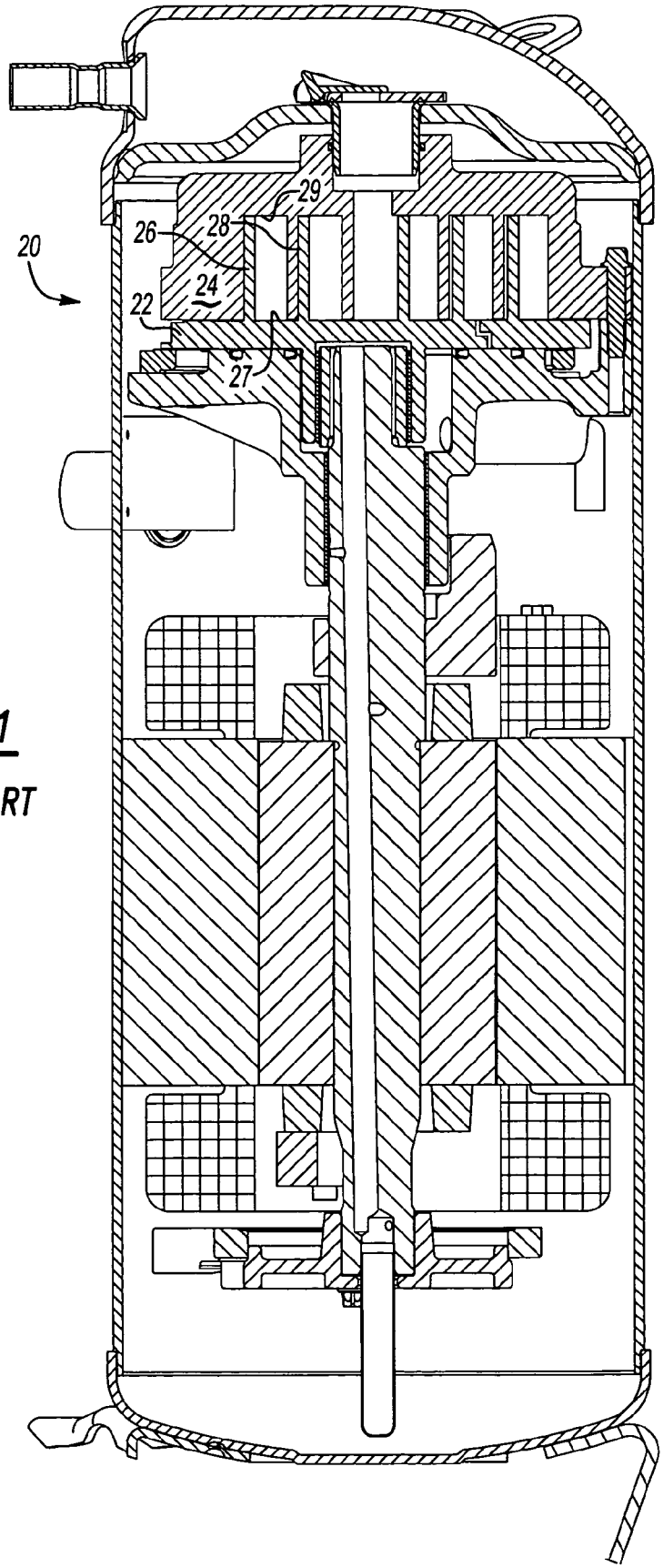
Fig-1 PRIOR ART
FIG. 1 is a cross-sectional view through a prior art scroll compressor.
Figure 2:
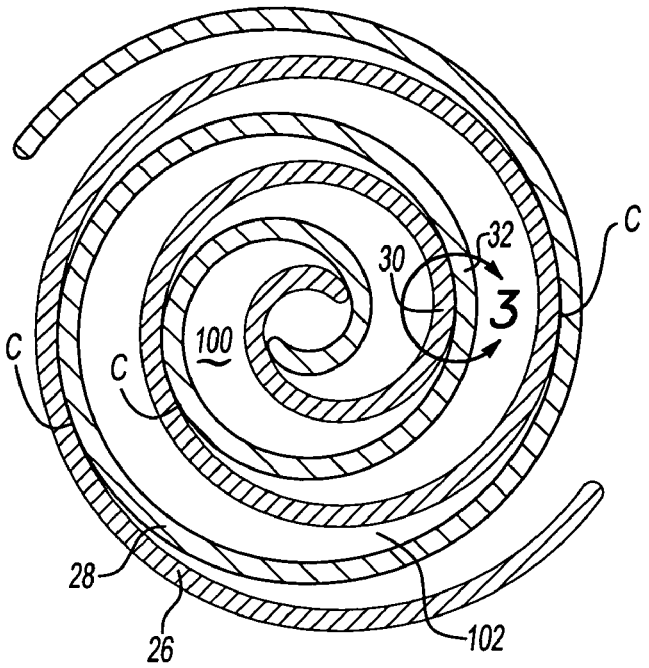
Fig-2 PRIOR ART
FIG. 2 shows a problem with the prior art scroll compressor.
Figure 3:
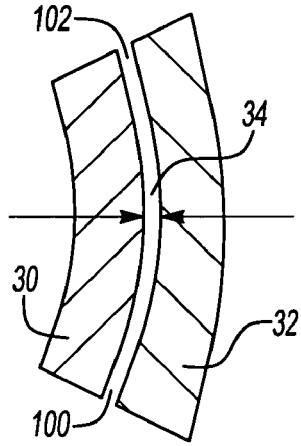
Fig-3 PRIOR ART
FIG. 3 is an enlarged view of a portion of FIG. 2 showing the prior art problem.
Figure 4:
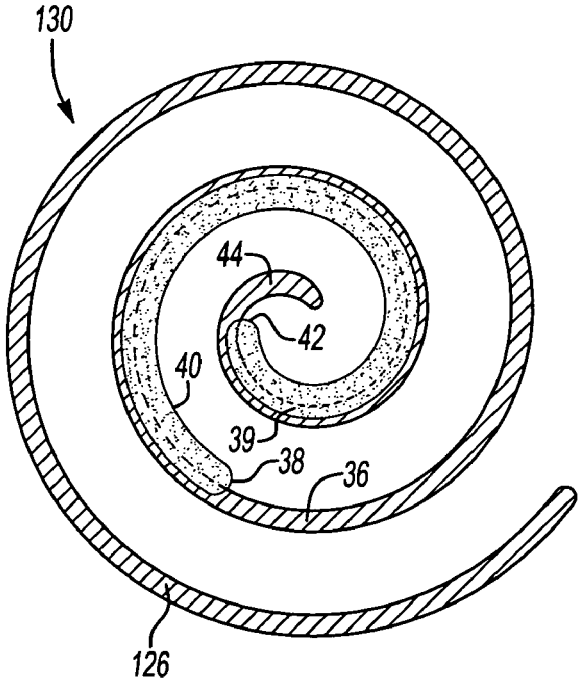
FIG. 4 is a first step in forming an inventive scroll compressor.

A wrap 126 is shown in FIG. 4. It should be understood that the present invention may preferably be utilized on the wraps of both the orbiting and non-orbiting scroll. It is within the scope of this invention that only one of the two scrolls carry the coating. As shown, the wrap has a radially outer portion 36, which preferably extends for at least 360°. Notably, and by comparing FIG. 4 to FIG. 2, it is clear that a portion of the uncoated portions 36 will include some of the contact points C. In this manner, the load can be born by these radially outer contact points. This portion is left uncoated, and formed of the metal typically utilized to form scroll wraps. A ditch begins at portion 38, and has a depth 39 extending to an end point 42. A coating 40 is placed within the ditch 39. Notably, there is an uncoated portion 44 radially inwardly of the end point 42 of the ditch. Notably, it is possible that the inner end is also coated. The scroll compressor is provided with this coating, with the coating being thick enough such that it will allow the scroll compressor to "run-in" eliminating any gaps such as the gaps shown in FIG. 3 which may be due to machining variations, tolerances, etc. It should be understood that the problem shown, for example, in FIG. 3, is most pronounced at radially inner locations along the wraps wherein the compressed refrigerant is reaching higher pressures. While any appropriate coating may be approved, examples of appropriate abradable or conformable coatings include iron phosphate coatings, magnesium phosphate coatings, nickel polymer amalgams, and other materials that abrade or yield plastically when a force is applied. The coated scroll 130 may be on either the orbiting or non-orbiting scroll, or both.

During run-in, the coating 40 will wear away to ideally match the desired shape for the particular scroll compressor.

The uncoated outer portion 36 will bear the radial load of force between the two scroll members, and thus the radial load will not be born by the coated portion.

Figure 5:
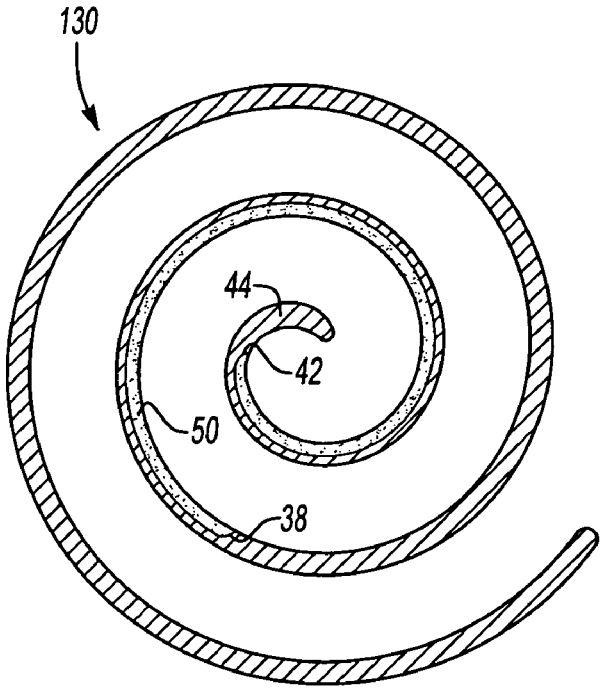
FIG. 5 shows the final shape of the scroll compressor provided by this invention.

FIG. 5 shows the wrap after run-in. The coating will now have a surface 50 that has moved away from the surface 40 as shown in FIG. 4. Thus, with this coating, the seal leakage such as shown in FIG. 3 will be eliminated.

Figure 6:
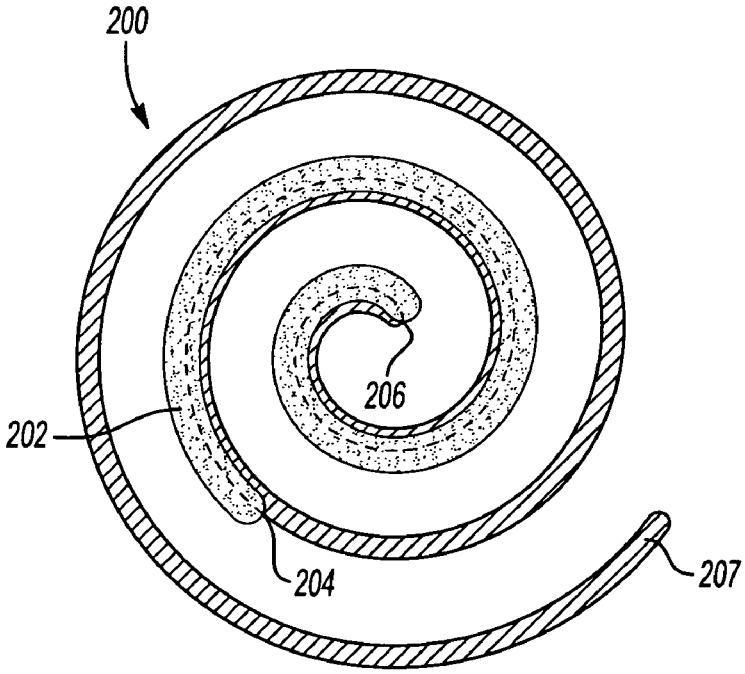
FIG. 6 shows another embodiment.

FIG. 6 shows another embodiment scroll member 200 wherein the coating material 202 is formed in a ditch 204 in the radially outer face of the scroll wrap. In such an embodiment, the coating material 202 preferably extends to the tip 206 of the wrap. Notably, the coating material does not begin for at least 360° measured from an outermost edge 207 of the wrap.

The coatings that are most suited for this application could be generically described as a coating that will move when the coated scroll member is brought into contact with the mating surface. For purposes of this application, this would mean that when the scroll wrap is brought into contact with the opposed mating scroll wrap, the coating will move to take on the shape defined by the opposed wrap, and eliminate the gap. The coating could be a "conformable" coating that under the influence of pressure or relative motion from the opposed mating scroll wrap, will take on a shape defined by the mating wrap. The coating will typically have a bulk hardness or strength which is somewhat less than that of the mating wrap of the opposed scroll member, and for that matter, also of the material utilized to form the scroll wrap on which it is deposited. Composite coatings may be utilized which could be made up of two or more mechanically bonded components. As an example, a carbon fiberfill resin, although this particular example would be a somewhat unlikely example. In such a composite, one or more of the coating components may have a hardness or strength equal to or greater than the scroll members, but the aggregate of the two would result in the coating having a hardness or strength which is less than that of the scroll members.

Another example of a conformable coating would be an extrudable or deformable coating. This is a type of conformable coating which when brought into contact with the mating surface and under the influence of pressure and/or relative motion, plastically extrudes or flows until it takes on a shape defined by the mating surface. This type of coating typically does not wear or flake away. The coating material remains attached to the coated wrap. Such coatings are often of a composite type with a harder matrix material to provide structural integrity and a softer filler component to lower the bulk hardness and allow the material to flow. Such materials have been utilized, as an example, in screw compressors wherein a known coating was a nickel-polymer aggregate. In such a coating, a nickel "foam" is filled with a soft polymer material. Open metal foams may be desirable for this application. However, such forms may also have some difficulty in that parts of the metal foam may sometimes break away, which could result in undesirable abrasive debris. In the known nickel-polymer aggregate, the polymer nodules provide an internal hydrostatic-type support to prevent the metal matrix from bending too much locally, which provides the benefit of good bond strength holding the deformed metal in place.

Another type of coating within the scope of this invention is an abradable coating. This is a type of coating which wears or flakes away under the influence of pressure and/or shape from the mating wrap of the opposed scroll member. Such coatings tend to be soft, and if they are formed of a composite, all of the components are typically soft. The wear debris will circulate through the rest of the compressor mechanism, and it would be undesirable to have an unduly abrasive "grit" provided by such an abradable coating.

For purposes of this application, the above coatings are generally referred to as coatings which will change their shape upon the influence of the opposed mating wrap of the opposed scroll member. In that sense, the material of the coating will move upon contact with the wrap of the mating scroll member. This "changing" and "movement" can be abrasion or the type of movement without abrasion provided by a conformable coating.

Although preferred embodiments of this invention have been shown, a worker of ordinary skill in this art would recognize that certain modifications would come within the scope of this invention. For that reason, the following claims should be studied to determine the true scope and content of this invention.

What is claimed is:

1. A scroll compressor comprising:

a first scroll member having a base and a generally spiral wrap extending from said base;

a second scroll member having a base and a generally spiral wrap extending from its base, said second scroll member being caused to orbit relative to said first scroll member, said wraps having flank walls in contact with each other at contact points; and said wraps of at least one of said first and second scroll members including a coating at radially inner portions of said generally spiral wrap, and on a flank wall, with said coated generally spiral wrap having outer portions which remain uncoated, said coating being formed of a coating material which will change its shape when it encounters the mating surface of the other of said first and second scroll members, such that as said second scroll member is caused to orbit relative to said first scroll member, said coating moving to result in a close tolerance fit between said flank walls of said generally spiral wraps of said first and second scroll members, with radially outer portions of said wrap bearing a load between said first and second scroll members.

2. A scroll compressor as recited in claim 1, wherein both said first and second scroll members have a generally spiral wrap with inner coated portions and outer non-coated portions.

3. A scroll compressor as recited in claim 1, wherein said wrap has a ditch extending into a face of said wrap, and said coating being deposited into said ditch.

4. A scroll compressor as recited in claim 3, wherein said coating is an abradable coating.

5. A scroll compressor as recited in claim 1, wherein said coating is a conformable coating.

6. A scroll compressor as recited in claim 1, wherein there are radially inner and radially outer contact points, with said uncoated portion including at least one set of said radially outer contacts points, and said coated portion including at least one set of said radially inner contact points.

7. A scroll compressor as recited in claim 1, wherein said coating is formed on a radially outer flank wall.

8. A method of forming a scroll compressor comprising the steps of:

(1) providing first and second scroll members, with each of said scroll members including a base and generally spiral wrap extending from said base, said wraps having flank walls in contact with each other at contact points;

(2) providing a coating on said wrap of at least one of said first and second scroll members, and on said flank wall, with said coating being a coating material which will change its shape when it encounters the mating surface of the other of said first and second scroll members, and formed only at radially inner portions of said generally spiral wrap, with radially outer portions left uncoated; and (3) causing said second scroll member to orbit relative to said first scroll member with coated flank wall moving along said flank wall of the other of said first and second scroll members such that said abradable coating moves to match said flank wall of said other of said first and second scroll members and results in a tight tolerance between said scroll wrap flank walls.

9. A method as set forth in claim 8, wherein both said first and second scroll members are provided with said coating at radially inner portions of said generally spiral wrap.

10. A method as set forth in claim 8, wherein there being radially inner and radially outer sets of said contact points, with said uncoated radially outer portions of said flank wall forming part of said radially outer contact points, and said coated portion of said flank wall forming said radially inner contact points.

* * * * *